US007651318B2

(12) United States Patent
Suga et al.

(10) Patent No.: US 7,651,318 B2
(45) Date of Patent: Jan. 26, 2010

(54) STEAM TURBINE

(75) Inventors: Takeo Suga, Yokohama (JP); Ryuichi Ishii, Tokyo (JP); Takeo Takahashi, Yokohama (JP); Masafumi Fukuda, Saitama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 521 days.

(21) Appl. No.: 11/783,140

(22) Filed: Apr. 6, 2007

(65) Prior Publication Data

US 2007/0253811 A1 Nov. 1, 2007

(30) Foreign Application Priority Data

Apr. 28, 2006 (JP) ..... P2006-125854

(51) Int. Cl.
*F04D 29/58* (2006.01)

(52) U.S. Cl. ..... 415/178; 415/115; 415/116; 415/176; 415/200

(58) Field of Classification Search ..... 415/115, 415/116, 175, 176, 177, 178, 179, 200, 108; 416/95, 96 R
See application file for complete search history.

(56) References Cited

U.S. PATENT DOCUMENTS

| | | | | |
|---|---|---|---|---|
| 4,550,569 | A | 11/1985 | Isa et al. | |
| 4,844,755 | A * | 7/1989 | Hashimoto et al. | 148/325 |
| 4,917,738 | A * | 4/1990 | Takano et al. | 148/325 |
| 7,128,791 | B2 * | 10/2006 | Horiuchi et al. | 148/325 |
| 7,169,239 | B2 * | 1/2007 | Reavis et al. | 148/320 |
| 7,404,438 | B2 * | 7/2008 | Reavis et al. | 166/242.1 |
| 2004/0261417 | A1 | 12/2004 | Yamashita et al. | |

FOREIGN PATENT DOCUMENTS

| | | |
|---|---|---|
| EP | 0 759 499 A1 | 2/1997 |
| EP | 0 806 490 A1 | 11/1997 |
| EP | 1 473 442 A2 | 11/2004 |
| JP | 60-104703 | 6/1985 |
| JP | 61-004804 | 1/1986 |
| JP | 6-137110 | 5/1994 |

(Continued)

OTHER PUBLICATIONS

European Search Report and Opinion mailed on Aug. 19, 2009, from the European Patent Office in counterpart European Application No. 07008118.7.

*Primary Examiner*—Igor Kershteyn
(74) *Attorney, Agent, or Firm*—Finnegan, Henderson, Farabow, Garrett & Dunner, L.L.P.

(57) ABSTRACT

A super steam turbine (100) into which high-temperature steam of 650° C. or more is introduced is provided with an inner steam pipe (120) which is disposed through an inner casing (110) and an outer casing (111), an outer steam pipe (130) which is welded to the outer casing (111) and disposed outside of the inner steam pipe (120) along the inner steam pipe (120) with a prescribed space therebetween, and a radiation heat shielding pipe (140) which is disposed along the inner steam pipe (120) between the inner steam pipe (120) and the outer steam pipe (130) to face a welded portion of at least the outer steam pipe (130), wherein cooling steam (160) is flown between the inner steam pipe (120) and the outer steam pipe (130), respective component parts are made of a suitable heat-resisting steel having prescribed chemical composition ranges.

6 Claims, 4 Drawing Sheets

FOREIGN PATENT DOCUMENTS

| | | |
|---|---|---|
| JP | 8-277703 | 10/1996 |
| JP | 08-333657 | 12/1996 |
| JP | 9-32506 | 2/1997 |
| JP | 11-229817 | 8/1999 |
| JP | 2001-65308 | 3/2001 |
| JP | 2004-346932 | 12/2004 |

* cited by examiner

STEAM TURBINE

CROSS-REFERENCE TO RELATED APPLICATIONS

This application is based upon and claims the benefit of priority from the prior Japanese Patent Application No. 2006-125854 filed on Apr. 28, 2006; the entire contents of which are incorporated herein by reference.

BACKGROUND

1. Field of the Invention

The present invention relates to a steam inlet portion of a steam turbine into which high-temperature steam flows as a working fluid, and more particularly to a steam turbine which has its respective component parts made of a suitable heat-resisting steel.

2. Description of the Related Art

Energy saving of the thermal power plant is being performed vigorously after the energy crisis, and technology for suppression of the emission of $CO_2$ has being attracting attention in view of the global environmental protection in these years. As part of it, needs for a highly efficient plant are increasing.

To increase power generation efficiency of the steam turbine, it is very effective to raise the turbine steam temperature to a high level, and the thermal power plant having the steam turbine has its steam temperature raised to 600° C. or more in these years. There is a tendency that the steam temperature will be increased to 650° C., and further to 700° C. in future.

In a case where the steam turbine having high-temperature steam of exceeding 650° C. as a working fluid has its respective portions formed of the same materials as the conventional materials, the steam turbine cannot withstand the high-temperature steam of exceeding 650° C., and it is necessary to use a heat-resisting material for the portions which are exposed to the high-temperature steam or to cool such portions. Besides, it is necessary to connect a turbine casing and a steam pipe at a turbine inlet portion through which the high-temperature steam is introduced into the steam turbine, but the turbine casing and the steam pipe are sometimes formed of different materials at such a portion. If materials having a large difference in coefficient of linear expansion are used to form the turbine casing and the steam pipe, there is a drawback that a large thermal stress is generated in the material-welded portion as a steam temperature increases.

Here, as the materials for the outer casing of a conventional 600° C. class steam turbine, there were used, for example, a cast steel which contained C: 0.05 to 0.15, Si: 0.3 or less, Mn: 0.1 to 1.5, Ni: 1.0 or less, Cr: 9 or more and less than 10, V: 0.1 to 0.3, Mo: 0.6 to 1.0, W: 1.5 to 2.0, Co: 1.0 to 4.0, Nb: 0.02 to 0.08, B: 0.001 to 0.008, N: 0.005 to 0.1, Ti: 0.001 to 0.03 and the balance of Fe and unavoidable impurities, and a heat-resisting cast steel which contained C: 0.12 to 0.18, Si: 0.2 to 0.6, Mn: 0.5 to 0.9, Cr: 1.0 to 1.5, Mo: 0.9 to 1.2, V: 0.2 to 0.35, Ti: 0.01 to 0.04 and the balance of Fe and unavoidable impurities, and the unavoidable impurities were suppressed to P: 0.02 or less, S: 0.012 or less, Al: 0.01 or less, Ni: 0.5 or less and Cu: 0.35 or less. And, as a piping material, for example, there was used a heat-resisting steel which contained C: 0.08 to 0.12, Si: 0.2 to 0.5, Mn: 0.3 to 0.6, Cr: 8.0 to 9.5, Mo: 0.85 to 1.05, V: 0.18 to 0.25, Nb: 0.06 to 0.10, N: 0.03 to 0.07, and the balance of Fe and unavoidable impurities, and the unavoidable impurities were suppressed to P: 0.02 or less, S: 0.01 or less and Al: 0.04 or less. And, the material for the outer casing and the piping material were connected to configure the steam inlet portion of the steam turbine. The piping material is a material corresponding to HI STPA28 described in Interpretation-classified Table 1 of Codes for Thermal Power Generation Facilities.

To suppress the generation of a large thermal stress in the above described welded portion, to secure the strength in the welded portion between the steam pipe and the turbine casing and to prevent high-temperature oxidation, it is general to apply materials not having a large difference in coefficient of thermal expansion to the turbine casing and the steam pipe or to lower the temperatures of the materials by cooling the circumference of the welded portion with low-temperature steam as described in, for example, JP-A Hei 8-277703 (KOKAI), JP-A Hei 6-137110 (KOKAI), JP-A Hei 9-32506 (KOKAI), JP-A Hei 11-229817 (KOKAI) and JP-A 2001-65308 (KOKAI).

For example, as a conventional steam turbine employing a manner of lowering the temperature of the materials by cooling the circumference of the welded portion, a low Cr steel can be used for a steam turbine, into which steam at a level of 593° C. flows, by flowing cooling steam to the steam inlet portion as described in, for example, JP-A Hei 8-277703 (KOKAI). Technology of enhancing the cooling effect by producing a swirl flow of cooling steam is also as described in, for example, JP-A Hei 11-229817 (KOKAI) and JP-A 2001-65308 (KOKAI).

It is expected that the steam turbine which is installed in the thermal power system has a tendency to have higher temperatures of main steam and reheated steam in order to obtain high power generation efficiency in the future. For example, in a case where a steam turbine in which a steam temperature exceeds 650° C. is realized using the same material as those of a related art for the individual portions of the steam turbine, the steam turbine cannot withstand the high-temperature steam. Therefore, it is advisable to use heat-resisting materials such as a Ni-base alloy and an austenitic material as the materials for the steam turbine, but if such heat-resisting materials are applied to all the component parts of the steam turbine, the production cost becomes high. Besides, it is hard to produce integrally large products such as the turbine casing and the turbine rotor from the above heat-resisting materials.

In view of the above circumstances, it is desirable to suppress the applicable scope of the heat-resisting materials to the necessity minimum, and there is used a method that the heat-resisting materials are applied to only the portions exposed to high-temperature steam of 650° C. or more among the steam turbine component parts, the conventional materials are applied to the other portions, and they are connected. Thus, there can be adopted a method that the Ni-based alloy is used as the steam pipe material for the steam inlet portion for guiding the high-temperature steam to the steam turbine, and the conventional material is used for the other portions as much as possible. But, in a case where the above method is adopted, there is a drawback that a large thermal stress is produced in the welded portion between the steam pipe material and the material for the other portions with the increase of the metal temperatures if a difference in coefficient of linear expansion is large between them.

BRIEF SUMMARY OF THE INVENTION

The present invention provides a steam turbine which can secure the strength of a steam inlet portion and prevent high-temperature oxidation even if it has a temperature exceeding a level of 650° C.

According to an aspect of the invention, there is provided a steam turbine, comprising an inner steam pipe which is disposed through an inner casing and an outer casing and connected to a nozzle box; an outer steam pipe which is welded to the outer casing and disposed outside of the inner steam pipe along the inner steam pipe with a prescribed space between them; and a radiation heat shielding pipe which is disposed between the inner steam pipe and the outer steam pipe along the inner steam pipe to face a welded portion of at least the outer steam pipe, wherein cooling steam is flown between the inner steam pipe and the outer steam pipe, and high-temperature steam of 650° C. or more is introduced into the steam turbine; the outer casing is formed of a cast steel which contains in percent by weight C: 0.05 to 0.15, Si: 0.3 or less, Mn: 0.1 to 1.5, Ni: 1.0 or less, Cr: 9 or more and less than 10, V: 0.1 to 0.3, Mo: 0.6 to 1.0, W: 1.5 to 2.0, Co: 1.0 to 4.0, Nb: 0.02 to 0.08, B: 0.001 to 0.008, N: 0.005 to 0.1, Ti: 0.001 to 0.03, and the balance of Fe and unavoidable impurities; the inner casing, the inner steam pipe and the outer steam pipe are formed of at least one heat-resisting steel selected from (1) heat-resisting steel which contains in percent by weight C: 0.03 to 0.25, Si: 0.01 to 1.0, Mn: 0.01 to 1.0, Cr: 20 to 23, Mo: 8 to 10, Nb: 1.15 to 3.0, and the balance of Ni and unavoidable impurities, and the unavoidable impurities including Fe: 5 or less, P: 0.015 or less, S: 0.015 or less and Cu: 0.5 or less; (2) heat-resisting steel which contains in percent by weight C: 0.10 to 0.20, Si: 0.01 to 0.5, Mn: 0.01 to 0.5, Cr: 20 to 23, Co: 10 to 15, Mo: 8 to 10, Al: 0.01 to 1.5, Ti: 0.01 to 0.6, B: 0.001 to 0.006, and the balance of Ni and unavoidable impurities, and the unavoidable impurities including Fe: 5 or less, P: 0.015 or less, S: 0.015 or less and Cu: 0.5 or less; (3) heat-resisting steel which contains in percent by weight C: 0.05 to 0.25, Si: 0.1 to 1.0, Mn: 0.1 to 1.0, Cr: 20 to 24, Mo: 8 to 10, Nb: 1 to 3, REM: 0.01 to 1.0, and the balance of Ni and unavoidable impurities, the unavoidable impurities including Fe: 5 or less, Cu: 0.5 or less, P: 0.015 or less, S: 0.015 or less and Co: 1 or less, with a stress-relief heat treatment performed at 700 to 1000° C.; and (4) heat-resisting steel which contains in percent by weight C: 0.05 to 0.25, Si: 0.1 to 1.0, Mn: 0.1 to 1.0, Cr: 20 to 24, Co: 10 to 15, Mo: 8 to 10, B: 0.001 to 0.006, REM: 0.01 to 1.0, and the balance of Ni and unavoidable impurities, the unavoidable impurities including Fe: 5 or less, Cu: 0.5 or less, P: 0.015 or less, S: 0.015 or less, Al: 0.05 or less and Ti: 0.05 or less, with a stress-relief heat treatment performed at 700 to 1000° C.; and the radiation heat shielding pipe is formed of heat-resisting steel which contains in percent by weight C: 0.25 or less, Si: 1.5 or less, Mn: 2.0 or less, Ni: 19 to 22, Cr: 24 to 26, and the balance of Fe and unavoidable impurities, and the unavoidable impurities including P: 0.045 or less and S: 0.03 or less.

According to another aspect of the invention, there is provided a steam turbine, comprising an inner steam pipe which is disposed through an inner casing and an outer casing and connected to a nozzle box; an outer steam pipe which is welded to the outer casing and disposed outside of the inner steam pipe along the inner steam pipe with a prescribed space between them; and a radiation heat shielding pipe which is disposed between the inner steam pipe and the outer steam pipe along the inner steam pipe to face a welded portion of at least the outer steam pipe, wherein cooling steam is flown between the inner steam pipe and the outer steam pipe, and high-temperature steam of 650° C. or more is introduced into the steam turbine; the outer casing is formed of a heat-resisting cast steel which contains in percent by weight C: 0.12 to 0.18, Si: 0.2 to 0.6, Mn: 0.5 to 0.9, Cr: 1.0 to 1.5, V: 0.2 to 0.35, Mo: 0.9 to 1.2, Ti: 0.01 to 0.04, and the balance of Fe and unavoidable impurities, and the unavoidable impurities including P: 0.02 or less, S: 0.012 or less, Al: 0.01 or less, Ni: 0.5 or less and Cu: 0.35 or less; the inner casing, the inner steam pipe and the outer steam pipe are formed of at least one heat-resisting steel selected from (1) heat-resisting steel which contains in percent by weight C: 0.03 to 0.25, Si: 0.01 to 1.0, Mn: 0.01 to 1.0, Cr: 20 to 23, Mo: 8 to 10, Nb: 1.15 to 3.0, and the balance of Ni and unavoidable impurities, and the unavoidable impurities including Fe: 5 or less, P: 0.015 or less, S: 0.015 or less, Cu: 0.5 or less; (2) heat-resisting steel which contains in percent by weight C: 0.10 to 0.20, Si: 0.01 to 0.5, Mn: 0.01 to 0.5, Cr: 20 to 23, Co: 10 to 15, Mo: 8 to 10, Al: 0.01 to 1.5, Ti: 0.01 to 0.6, B: 0.001 to 0.006, and the balance of Ni and unavoidable impurities, and the unavoidable impurities including Fe: 5 or less, P: 0.015 or less, S: 0.015 or less and Cu: 0.5 or less; (3) heat-resisting steel which contains in percent by weight C: 0.05 to 0.25, Si: 0.1 to 1.0, Mn: 0.1 to 1.0, Cr: 20 to 24, Mo: 8 to 10, Nb: 1 to 3, REM: 0.01 to 1.0, and the balance of Ni and unavoidable impurities, and the unavoidable impurities including Fe: 5 or less, Cu: 0.5 or less, P: 0.015 or less, S: 0.015 or less and Co: 1 or less, with a stress-relief heat treatment performed at 700 to 1000° C.; and (4) heat-resisting steel which contains in percent by weight C: 0.05 to 0.25, Si: 0.1 to 1.0, Mn: 0.1 to 1.0, Cr: 20 to 24, Co: 10 to 15, Mo: 8 to 10, B: 0.001 to 0.006, REM: 0.01 to 1.0, and the balance of Ni and unavoidable impurities, and the unavoidable impurities including Fe: 5 or less, Cu: 0.5 or less, P: 0.015 or less, S: 0.015 or less, Al: 0.05 or less and Ti: 0.05 or less, with a stress-relief heat treatment performed at 700 to 1000° C.; and the radiation heat shielding pipe is formed of heat-resisting steel which contains in percent by weight C: 0.25 or less, Si: 1.5 or less, Mn: 2.0 or less, Ni: 19 to 22, Cr: 24 to 26, and the balance of Fe and unavoidable impurities, and the unavoidable impurities including P: 0.045 or less and S: 0.03 or less.

BRIEF DESCRIPTION OF THE DRAWINGS

The present invention is described with reference to the drawings, which are provided for illustration only and do not limit the present invention in any respect.

DETAILED DESCRIPTION OF THE INVENTION

Embodiments of the invention will be described with reference to the drawings.

FIRST EMBODIMENT

An overview of a steam turbine power generation system 10 provided with the steam turbine of the first embodiment of the invention will be described with reference to FIG. 1 through FIG. 4.

Figure 1:
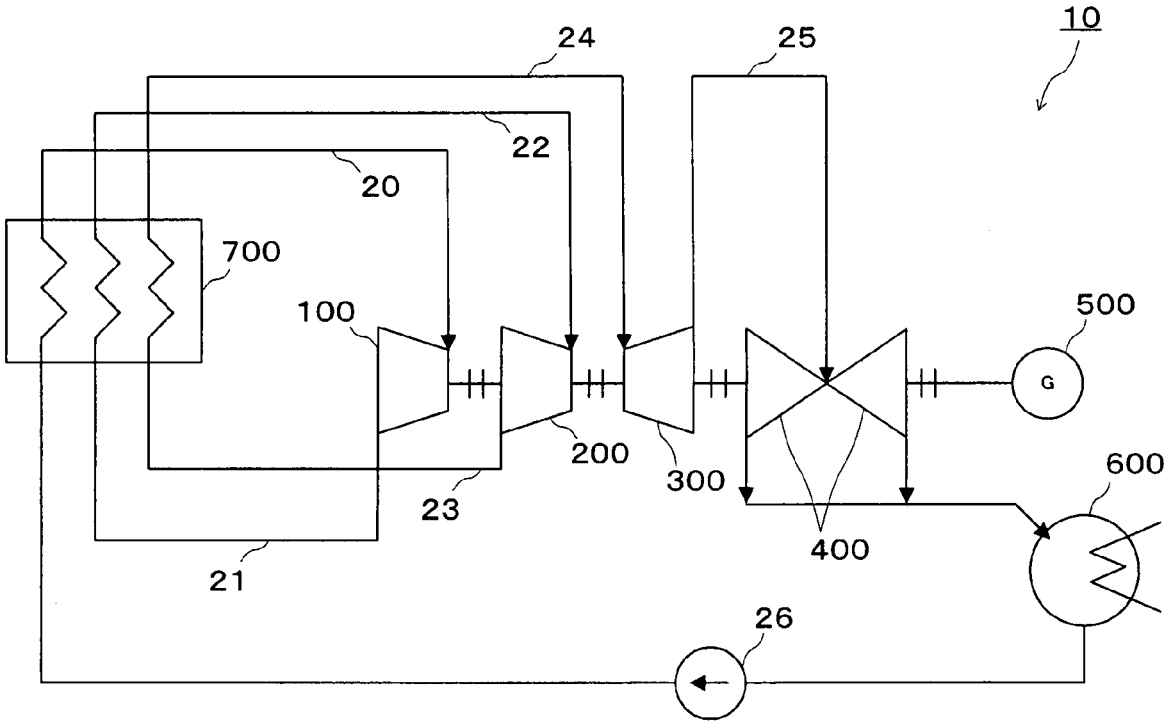
FIG. 1 is a diagram schematically showing an overview of a steam turbine power generation system provided with the steam turbine according to a first embodiment of the invention.
Figure 2:
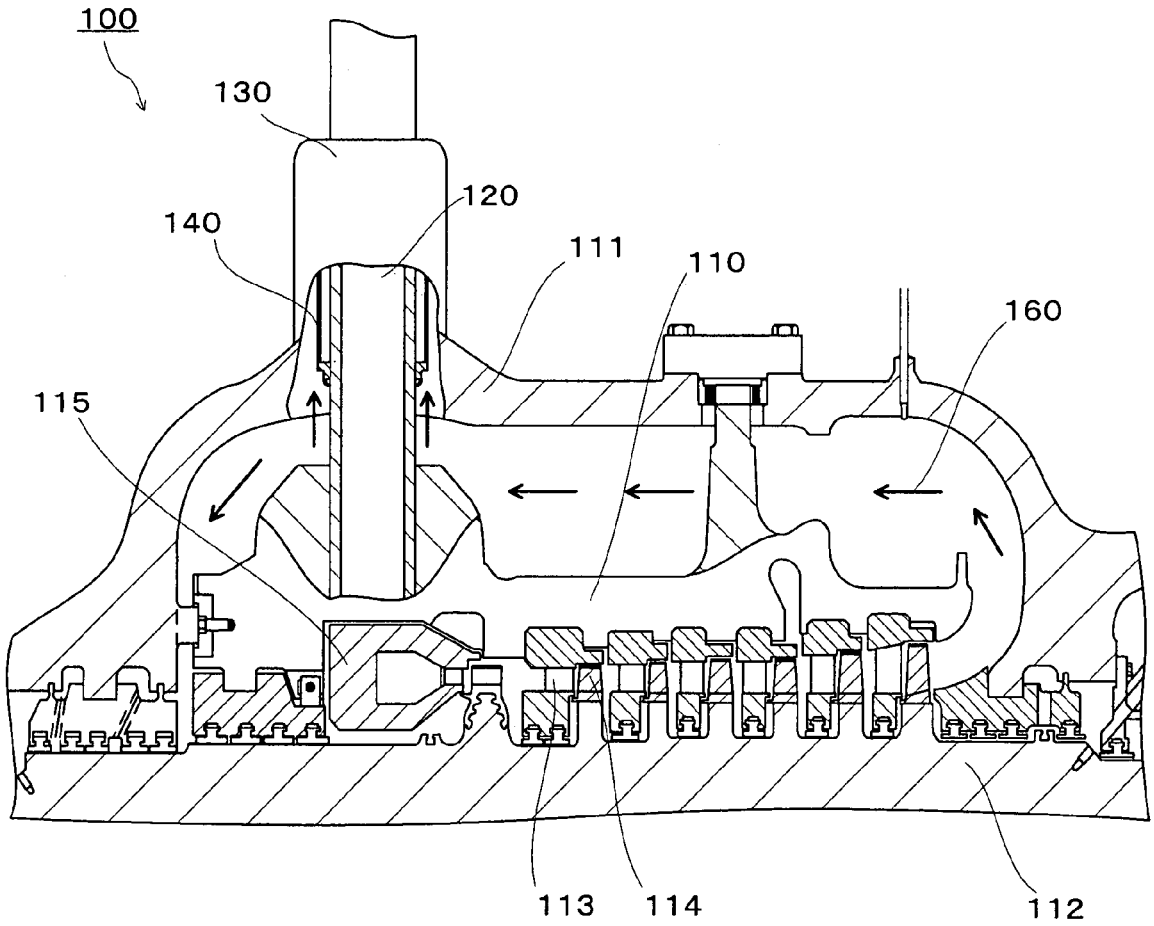
FIG. 2 is a diagram showing a cross section of an upper-half casing portion of an extra-high-pressure turbine.
Figure 3:
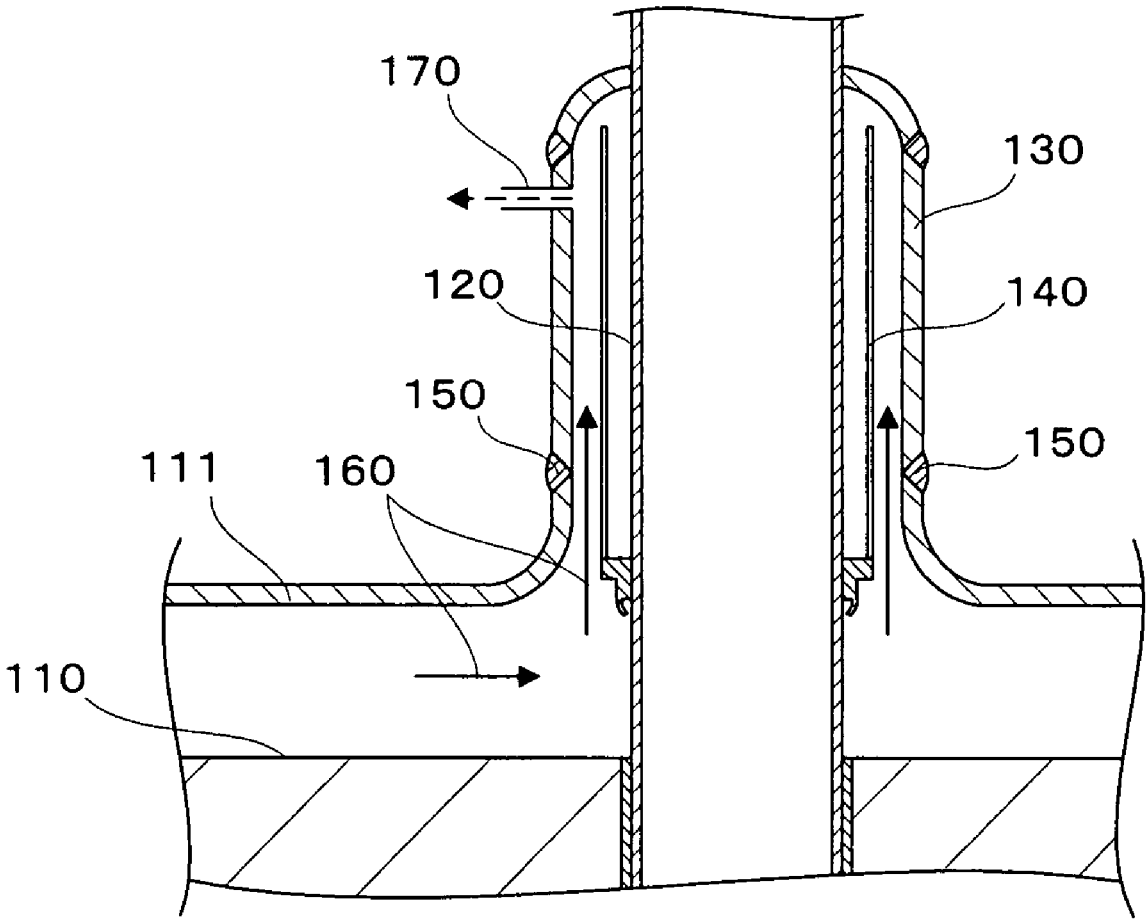
FIG. 3 is a diagram showing a cross section of a turbine steam inlet portion of the extra-high-pressure turbine.
Figure 4:
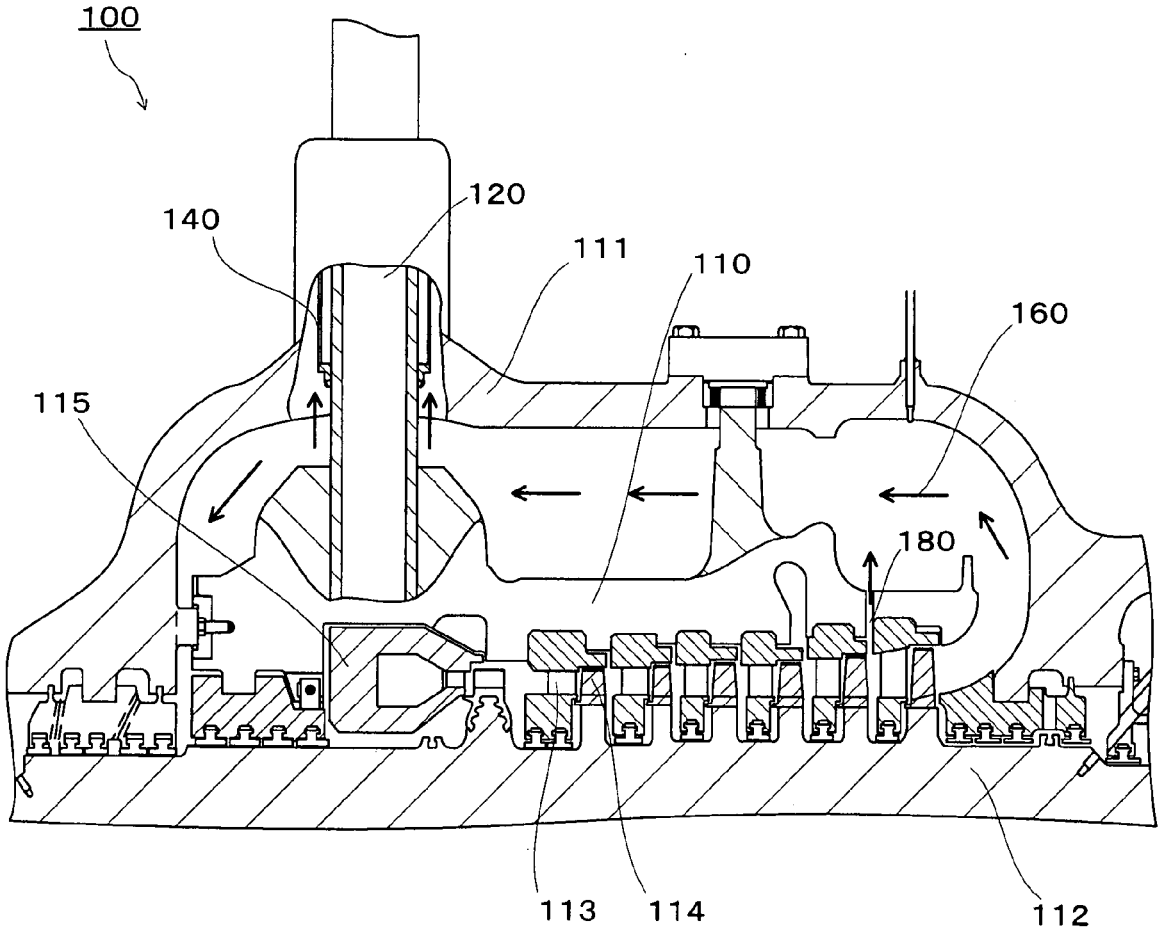
FIG. 4 is a diagram showing a cross section of an upper-half casing portion of an extra-high-pressure turbine according to a cooling steam introducing method different from the cooling steam introducing method shown in FIG. 2.

FIG. 1 is a diagram schematically showing an overview of the steam turbine power generation system 10 provided with the steam turbine according to the first embodiment. FIG. 2 is a diagram showing a cross section of an upper-half casing portion of an extra-high-pressure turbine 100. FIG. 3 is a diagram showing a cross section of a turbine steam inlet portion of the extra-high-pressure turbine 100. FIG. 4 is a diagram showing a cross section of an upper-half casing portion of the extra-high-pressure turbine 100 according to a cooling steam introducing method different from the cooling steam introducing method shown in FIG. 2.

The steam turbine power generation system 10 is mainly configured of the extra-high-pressure turbine 100, a high-pressure turbine 200, an intermediate-pressure turbine 300, a low-pressure turbine 400, a generator 500, a condenser 600, and a boiler 700.

Subsequently, an operation of steam in the steam turbine power generation system 10 will be described.

Steam heated to a temperature of 650° C. or more in the boiler 700 and flown out of it enters the extra-high-pressure turbine 100 through a main steam pipe 20. For example, it is assumed that the moving blades of the extra-high-pressure turbine 100 are configured of seven stages. Then, the steam having performed the expansion work in the extra-high-pressure turbine 100 is discharged from a seventh-stage outlet and flown into the boiler 700 through a cold reheat pipe 21. The boiler 700 reheats the received steam, and the reheated steam flows into the high-pressure turbine 200 through a hot reheat pipe 22.

For example, it is assumed that the moving blades of the high-pressure turbine 200 are configured of seven stages. Then, the steam having entered the high-pressure turbine 200 performs an expansion work in it and is discharged from a seventh-stage outlet to flow into the boiler 700 through a cold reheat pipe 23. The boiler 700 reheats the received steam, and the reheated steam flows into the intermediate-pressure turbine 300 through a hot reheat pipe 24.

For example, it is assumed that the moving blades of the intermediate-pressure turbine 300 are configured of seven stages. Then, the steam having entered the intermediate-pressure turbine 300 performs an expansion work in it and is discharged from the seventh-stage outlet and supplied into the low-pressure turbine 400 through a crossover pipe 25.

The steam having been supplied to the low-pressure turbine 400 performs an expansion work and is condensed into water by the condenser 600. The condensate has its pressure increased by a boiler feed pump 26 and is circulated to the boiler 700. The condensate circulated to the boiler 700 is heated to become high-temperature steam of 650° C. or more and supplied to the extra-high-pressure turbine 100 through the main steam pipe 20 again. The generator 500 is driven to rotate by the expansion works of the individual steam turbines to generate electric power. It should be noted that the low-pressure turbine 400 described above has two low-pressure turbine sections having the same structure tandem-connected but is not limited to the described structure.

A structure of the extra-high-pressure turbine 100 having the steam turbine structure of an embodiment according to the invention will be described with reference to FIG. 2 and FIG. 3.

As shown in FIG. 2, the extra-high-pressure turbine 100 has a double-structured casing which is comprised of an inner casing 110 and an outer casing 111 which is disposed to cover it. A turbine rotor 112 is disposed through the inner casing 110. For example, a seven stage nozzle 113 is disposed on the inner surface of the inner casing 110, and moving blades 114 are implanted in the turbine rotor 112. Besides, an inner steam pipe 120 is disposed on the extra-high-pressure turbine 100 through the outer casing 111 and the inner casing 110, and an end of the inner steam pipe 120 is connected to communicate with a nozzle box 115 which discharges steam toward the moving blades 114.

As shown in FIG. 3, an outer steam pipe 130 is disposed along the outside of the inner steam pipe 120 with a prescribed space between them with its top end welded to the inner steam pipe 120 and the bottom end welded to the outer casing 111. And, a radiation heat shielding pipe 140 is disposed along the inner steam pipe 120 and between the inner steam pipe 120 and the outer steam pipe 130. The radiation heat shielding pipe 140 is disposed between the inner steam pipe 120 and the outer steam pipe 130 with a prescribed space provided with respect to the individual steam pipes so not to come into contact with them and has its one end fixed to the outer circumferential surface of the inner steam pipe 120. And, the radiation heat shielding pipe 140 is disposed along the inner steam pipe 120 to face at least a welded portion 150 between the outer steam pipe 130 and the outer casing 111.

The radiation heat shielding pipe 140 is disposed to suppress the welded portion 150 from being heated because of radiation heat which is directly conducted from the inner steam pipe 120 to the outer steam pipe 130. The radiation heat shielding pipe 140 is desirably configured to have substantially the same length as that of the outer steam pipe 130. Thus, the radiation heat from the inner steam pipe 120 can be prevented from being conducted directly to the welded portion 150 regardless of the position of the welded portion 150. And, a cooling steam discharge port 170 for discharging cooling steam 160, which is introduced between the outer steam pipe 130 and the inner steam pipe 120, is disposed at an upper part of the outer steam pipe 130.

The extra-high-pressure turbine 100 is provided with an outer casing cooling means which cools the outer casing 111 by introducing the steam having performed the expansion work partly as the cooling steam 160 between the inner casing 110 and the outer casing 111, and the cooling steam 160 is partly introduced between the outer steam pipe 130 and the inner steam pipe 120.

Subsequently, an operation of steam in the extra-high-pressure turbine 100 will be described.

The steam having a temperature of 650° C. or more flown into the nozzle box 115 within the extra-high-pressure turbine 100 through the inner steam pipe 120 passes through a steam passage between the nozzle 113 fixed to the inner casing 110 and the moving blades 114 implanted in the turbine rotor 112 to rotate the turbine rotor 112. A large force is applied to the individual portions of the turbine rotor 112 by an influence of the great centrifugal force due to the rotations. And, the steam having performed the expansion work is mostly discharged and enters the boiler 700 through the cold reheat pipe 21.

Meanwhile, the steam having performed the expansion work is partly guided as the cooling steam 160 between the inner casing 110 and the outer casing 111 to cool the outer casing 111 and discharged from a ground portion or a discharge path from which the steam having performed the expansion work is mostly discharged. The cooling steam 160 having a temperature of about 500° C. is partly introduced between the outer steam pipe 130 and the inner steam pipe 120 and receives the heat from the radiation heat shielding pipe 140 by convection to cool the radiation heat shielding pipe 140 and also cool the outer casing 111 and the welded portion 150. The cooling steam 160 having cooled the radiation heat shielding pipe 140 is discharged from the cooling steam discharge port 170. The surface temperatures of the outer casing 111 and the outer steam pipe 130 are kept at 600° C. or less by means of the radiation heat shielding pipe 140 and the cooling steam 160. Here, it may be configured to allow the cooling steam 160 to flow between the inner steam pipe 120 and the radiation heat shielding pipe 140 to cool the radiation heat shielding pipe 140 and the inner steam pipe 120.

It is described above as an example that the extra-high-pressure turbine 100 uses the steam having performed the expansion work partly as the cooling steam 160. But, the method of introducing the cooling steam 160 is not limited to the above method. For example, steam extracted from a halfway stage 180 of the extra-high-pressure turbine 100 may be used as the cooling steam 160 as shown in FIG. 4.

For example, the extra-high-pressure turbine 100 is assumed that the steam discharged from the extra-high-pressure turbine 100 has a temperature of about 500° C., but if the steam being discharged has a low temperature of about 400° C., cooling is excessively performed, possibly affecting on the service life of the material. But, the above configuration to extract the cooling steam 160 from the halfway stage 180 of the extra-high-pressure turbine 100 allows using the cooling steam 160 having an appropriate temperature.

In a case where a cooling means using the cooling steam 160 is not provided and the outer casing 111 and the outer steam pipe 130 are exposed to high-temperature steam of about 650 to 700° C., the materials forming them and described later each have a coefficient of linear expansion of about $12.7\times10^{-6}$/° C. and about $18.5\times10^{-6}$/° C. And, a coefficient of linear expansion of their bonded portion has a numerical value which is about an intermediate value between the above two values. By cooling the outer casing 111 and the outer steam pipe 130 to about 600° C. by the outer casing cooling means, the material forming the outer casing 111 has a coefficient of linear expansion of about $12.5\times10^{-6}$/° C., and the material forming the outer steam pipe 130 has a coefficient of linear expansion of about $14.5\times10^{-6}$/° C. Thus, a sufficient welded joint strength can be assured in terms of design for the respective materials and the bonded portion.

The conventional steam turbine has a steam temperature of 600° C. or less, so that, for example, a 9Cr pipe is used for the steam pipe which is connected to the casing formed of 12Cr or the like. But, the 9Cr pipe cannot be used as the steam pipe when the steam temperature is in a range of 650 to 700° C. Therefore, the present invention has the steam inlet portion formed to have a double structure which is comprised of the inner steam pipe 120 and the outer steam pipe 130 using the heat-resisting steel described later to secure the welded joint strength at the bonded portion between the outer steam pipe 130 and the outer casing 111 by adopting a structure provided with a cooling means comprising the radiation heat shielding pipe 140 and the cooling steam 160, different from the structure of the steam inlet portion of the conventional steam turbine.

Material forming the inner casing 110, the outer casing 111, the nozzle box 115, the inner steam pipe 120, the outer steam pipe 130 and the radiation heat shielding pipe 140 configuring the extra-high-pressure turbine 100 will be described. It should be noted that the ratio of chemical compositions described below is expressed in "percent by weight".

(1) Inner Casing 110, Nozzle Box 115, Inner Steam Pipe 120 and Outer Steam Pipe 130

For the material forming the inner casing 110, the nozzle box 115, the inner steam pipe 120 and the outer steam pipe 130, a heat-resisting steel (M1) having the following chemical composition ranges is used. (M1) Heat-resisting steel which contains C: 0.03 to 0.25, Si: 0.01 to 1.0, Mn: 0.01 to 1.0, Cr: 20 to 23, Mo: 8 to 10, Nb: 1.15 to 3.0, and the balance of Ni and unavoidable impurities; and the unavoidable impurities are suppressed to Fe of 5 or less, P of 0.015 or less, S of 0.015 or less, and Cu of 0.5 or less.

Reasons of limiting the individual components of the heat-resisting steel (M1) to the above-described ranges will be described.

(M1-a) C (Carbon)

C is useful as a component element of $M_{23}C_6$ type carbide which is a strengthening phase, and particularly, the creep strength of the heat-resisting steel is maintained by precipitating the $M_{23}C_6$ type carbide during the operation of the steam turbine in a high-temperature environment of 650° C. or more. Because the inner casing 110 is produced as a large cast product, the fluidity of the molten metal is required at the time of casting, and C also has an effect of assuring the fluidity of the molten metal. If the C content is less than 0.03%, a sufficient precipitation amount of the carbide cannot be assured, and the fluidity of the molten metal at the time of casting is degraded considerably. Meanwhile, if the C content exceeds 0.25%, the tendency of component segregation increases at the time of producing a large ingot, and the generation of $M_6C$ type carbide which is an embrittlement phase is promoted. Therefore, the C content is determined to be 0.03 to 0.25%.

(M1-b) Si (Silicon)

Si has a deoxidizing effect and also has an effect of assuring the fluidity of the molten metal. In a case where a large cast product is produced, a molten metal obtained by melting in the atmosphere is cast in the atmosphere. Therefore, deoxidization is more significant than when an ingot is produced by casting in vacuum, and the fluidity of the molten metal is particularly significant at the time of producing a large cast product. But, if the Si content exceeds 1.0%, toughness of heat-resisting steel lowers, and embrittlement in a high-temperature environment at 650° C. or more is promoted considerably. And, if the Si content is less than 0.01%, the deoxidizing effect is not attained, and the fluidity of the molten metal at the time of production of the ingot lowers. Therefore, the Si content is determined to be 0.01 to 1.0%.

(M1-c) Mn (Manganese)

Mn has a desulfurizing effect and an effect of increasing the fluidity of a molten metal. These effects are significant in the production of a large cast product which is produced by casting in the atmosphere the molten metal which is obtained by melting in the atmosphere. But, if the Mn content exceeds 1.0%, toughness of heat-resisting steel lowers and embrittlement in a high-temperature environment at 650° C. or more is promoted considerably. And, if the Mn content is less than 0.01%, the desulfurizing effect is not attained. Therefore, the Mn content is determined to be 0.01 to 1.0%.

(M1-d) Cr (Chromium)

Cr is indispensable as a component element of the $M_{23}C_6$ type carbide, and particularly, the creep strength of the heat-resisting steel is maintained by precipitating the $M_{23}C_6$ type carbide during the operation of the steam turbine in a high-temperature environment of 650° C. or more. And, Cr improves the resistance to oxidation in a high-temperature steam environment. If the Cr content is less than 20%, the resistance to oxidation decreases, and if the Cr content exceeds 23%, precipitation of the $M_{23}C_6$ type carbide is promoted considerably, resulting in increasing the tendency of coarsening. Therefore, the Cr content is determined to be 20 to 23%.

(M1-e) Mo (Molybdenum)

Mo provides an effect of forming a solid solution into a Ni mother phase to enhance the strength of the mother phase, and its partial substitution in the $M_{23}C_6$ type carbide enhances the stability of the carbide. If the Mo content is less than 8%, the above effect is not exerted, and if the Mo content exceeds 10%, a tendency of component segregation increases when a large ingot is produced, and the generation of $M_6C$ type carbide which is an embrittlement phase is promoted. Therefore, the Mo content is determined to be 8 to 10%.

(M1-f) Nb (Niobium)

Nb is mainly added as a component element of a γ" phase and a δ phase which contribute to enhancement of precipitation. If the Nb content is less than 1.15%, the precipitation amounts of the γ" phase and the δ phase are insufficient, and particularly, creep strength decreases. Meanwhile, if the Nb content exceeds 3.0%, the precipitation amounts of the γ" phase and the δ phase in a high-temperature environment of 650° C. or more increase sharply, and considerable embrittlement is caused in a short time. And, a tendency of component segregation when a large cast product is produced becomes considerable. Therefore, the Nb content is determined to be 1.15 to 3.0%.

(M1-g) Fe (Iron), P (Phosphorus), S (Sulfur) and Cu (Copper)

Many types of unavoidable impurities are mingled and remained in heat-resisting steel. Among them, the upper limits of four elements Fe, P, S and Cu are determined. The upper limit of P and S is determined to be 0.015% capable of suppressing embrittlement caused by grain boundary segregation in a high-temperature environment, and the upper limit of Cu is determined to be 0.5% which does not affect on the characteristics because Cu is unavoidably mingled in the production of steel. Where steel containing Fe as a main component element is melted, mingling of Fe is generally unavoidable. Therefore, its upper limit is determined to be 5% which does not affect on the characteristics. These unavoidable impurities are preferably decreased as low as industrially possible to a residual content of 0%.

(2) Outer Casing 111

As a material forming the outer casing 111, a cast steel (M2) having the following chemical composition ranges is used. (M2) Cast steel which contains C: 0.05 to 0.15, Si: 0.3 or less, Mn: 0.1 to 1.5, Ni: 1.0 or less, Cr: 9 or more and less than 10, V: 0.1 to 0.3, Mo: 0.6 to 1.0, W: 1.5 to 2.0, Co: 1.0 to 4.0, Nb: 0.02 to 0.08, B: 0.001 to 0.008, N: 0.005 to 0.1, Ti: 0.001 to 0.03, and the balance of Fe and unavoidable impurities.

Reasons of limiting the individual components of the cast steel (M2) to the above-described ranges will be described.

(M2-a) C (Carbon)

C is a useful element as a component element of the carbide which contributes to secure quenching property and precipitation strengthening. But, if the C content is less than 0.05%, the above effects are low and if it exceeds 0.15%, weldability is degraded. Therefore, the C content is determined to be 0.05 to 0.15%.

(M2-b) Si (Silicon)

Si is useful as a deoxidizing agent and an element for improving molten metal flowability but, if its content is high, the degradation of toughness and embrittlement are promoted. Therefore, its content is desired to be as low as possible in view of the above points. If the Si content exceeds 0.3%, the above properties are degraded considerably. Thus, the Si content is determined to be 0.3% or less. And, the Si content is preferably contained in at least 0.05% or more.

(M2-c) Mn (Manganese)

Mn is an element useful as a desulfurizing agent but, if its content is less than 0.1%, its desulfurizing effect is not attained, and if its content exceeds 1.5%, the creep strength is decreased. Therefore, the Mn content is determined to be 0.1 to 1.5%.

(M2-d) Ni (Nickel)

Ni improves quenching property and toughness. But, if the Ni content exceeds 1.0%, the creep resistance is decreased. Therefore, the Ni content is determined to be 1.0% or less. And, it is preferable that the Ni content is at least 0.05% or more.

(M2-e) Cr (Chrome)

Cr is effective as a component element of precipitates contributing to precipitation strengthening and inevitable for securing oxidation resistance and corrosion resistance. But, if the Cr content is less than 9.0%, the above effects are low, and if it is 10% or more, generation of ferrite is promoted, and particularly the degradation of the creep strength over a long period of time is promoted. Therefore, the Cr content is determined to be 9.0% or more and less than 10%.

(M2-f) V (Vanadium)

V contributes to the solid-solution strengthening and the formation of fine carbonitride. If the V content is 0.1% or more, fine precipitates are formed sufficiently to inhibit the recovering. But, if the V content exceeds 0.3%, coarsening of carbonitride is promoted. Accordingly, the V content is determined to be 0.1 to 0.3%.

(M2-g) Mo (Molybdenum)

Mo is useful as a solid-solution strengthening element and as a component element of carbide, and when the added Mo content is 0.6% or more, its effect is exerted. But, if the Mo content exceeds 1.0%, the degradation of toughness and the generation of ferrite are promoted. Therefore, the Mo content is determined to be 0.6 to 1.0%.

(M2-h) W (Tungsten)

W contributes to the solid-solution strengthening and also the precipitation strengthening by substituting into carbide and an intermetallic compound. It is necessary to have the W content of 1.5% or more in order to exert such effects, but if the W content exceeds 2.0%, the degradation of toughness and the generation of ferrite are promoted. Therefore, the W content is determined to be 1.5 to 2.0%.

(M2-i) N (Nitrogen)

N contributes to the precipitation strengthening by forming nitride or carbonitride. Besides, N remaining in the mother phase also contributes to the solid-solution strengthening but, if the N content is less than 0.005%, the above effects are not attained. Meanwhile, if the N content exceeds 0.1%, coarsening of nitride or carbonitride is promoted, the creep strength is decreased, and the generation of a coarse product is promoted. Therefore, the N content is determined to be 0.005 to 0.1%.

(M2-j) Co (Cobalt)

Co has effects to contribute to solid-solution strengthening and suppression of a tendency to generate ferrite. To achieve the above effects, the Co content is required to be 1.0% or more, but if the Co content is 4.0% or more, the effects are saturated, and economical efficiency is impaired considerably in a large steel ingot. Therefore, the Co content is determined to be 1.0 to 4.0%.

(M2-k) Nb (Niobium)

Nb contributes to precipitation strengthening by forming carbonitride. If the Nb content is less than 0.02%, the above effect is not attained. Meanwhile, if the Nb content exceeds 0.08%, coarse Nb carbonitride in a state of non-solid solution is produced in a large amount during the production of a steel ingot. Therefore, the Nb content is determined to be 0.02 to 0.08%.

(M2-l) Ti (Titanium)

Ti is useful as a deoxidizing agent and contributes to precipitation strengthening by forming carbonitride. If the Ti content is less than 0.001%, the above effects are not attained. Meanwhile, if the Ti content exceeds 0.03%, coarse Ti carbonitride in a state of non-solid solution is produced in a large amount during the production of a steel ingot. Therefore, the Ti content is determined to be 0.001 to 0.03%.

(M2-m) B (Boron)

B enhances quenchability when added in a very small amount and also makes it possible to stabilize carbonitride at a high temperature for a long period of time. Such effects are attained when the B content is 0.001% or more, and an effect to suppress coarsening of carbide precipitated on grain boundary and near the grain boundary is exerted, but if the B content exceeds 0.008%, considerable degradation of casting property and formation of a coarse product are promoted. Therefore, the B content is determined to be 0.001 to 0.008%.

Impurities incidentally mingled when the above-described components and the main component Fe are contained, namely unavoidable impurities, are desirably decreased to a level as low as possible, and a residual content of the unavoidable impurities is preferably decreased as low as industrially possible to 0%.

The outer casing 111 is cooled by an outer casing cooling means, so that the above-described ferrite-based cast steel excelling in productivity in casting or the like can be used. As a cast steel having basic components in the above ranges, there is "Alloy steel which contains in percent by weight C: 0.05 to 0.15, Si: 0.3 or less (not including 0), Mn: 0.1 to 1.5, Ni: 1.0 or less (not including 0), Cr: 9.0 or more and less than 10, V: 0.1 to 0.3, Mo: 0.6 to 1.0, W: 1.5 to 2.0, Co: 1.0 to 4.0, Nb: 0.02 to 0.08, B: 0.001 to 0.008, N: 0.005 to 0.1 and Ti: 0.001 to 0.03 and the balance of Fe and unavoidable impurities; has $M_{23}C_6$ type carbide mainly precipitated on grain boundary and martensite lath boundary by a tempering heat treatment; has $M_2X$ type carbonitride and MX type carbonitride precipitated within the martensite lath; has V and Mo contained in the component elements of the $M_2X$ type carbonitride in a relation of V>Mo; and has a total precipitate of the $M_{23}C_6$ type carbide, the $M_2X$ type carbonitride and the MX type carbonitride in 2.0 to 4.0% by weight" as described in, for example, JP-A 2005-60826 (KOKAI) and U.S. patent application Ser. No. 10/901,370. And, as a material for the outer casing 111, inexpensive low alloy cast steel, for example, 1% CrMoV cast steel may be used.

(3) Radiation Heat Shielding Pipe 140

As a material forming the radiation heat shielding pipe 140, a heat-resisting steel (M3) having the following chemical composition ranges is used. (M3) Heat-resisting steel which contains C: 0.25 or less, Si: 1.5 or less, Mn: 2.0 or less, Ni: 19 to 22, Cr: 24 to 26, and the balance of Fe and unavoidable impurities; and the unavoidable impurities are suppressed to P of 0.045 or less and S of 0.03 or less.

Reasons of limiting the individual components of the heat-resisting steel (M3) to the above-described ranges will be described.

(M3-a) C (Carbon)

C is useful as a component element of the $M_{23}C_6$ type carbide which is a strengthening phase, and particularly, the creep strength of the heat-resisting steel is maintained by precipitating the $M_{23}C_6$ type carbide during the operation of the steam turbine in a high-temperature environment of 650° C. or more. If the C content is small, embrittlement depending on weldability and heating at a high temperature for a long period of time is suppressed, but the precipitation amount of carbide decreases. Therefore, it is preferable that the C content is contained in at least 0.03% or more. Meanwhile, if the C content exceeds 0.25%, weldability lowers, and the tendency of embrittlement during the operation becomes prominent. Therefore, the C content is determined to be 0.25% or less.

(M3-b) Si (Silicon)

Si has a deoxidizing effect and also improves steam oxidation property of the heat-resisting steel according to the invention. If the Si content is small, toughness is improved, but the resistance to water vapor oxidation lowers. Therefore, the Si content is preferably contained in at least 0.05% or more. Meanwhile, if the Si content exceeds 1.5%, degradation of toughness and embrittlement in a high-temperature environment of 650° C. or more are promoted considerably. Therefore, the Si content is determined to be 1.5% or less.

(M3-c) Mn (Manganese)

Mn has a desulfurizing effect. But, if the Mn content exceeds 2.0%, an amount of a non-metallic inclusion remaining in steel increases considerably. Therefore, the Mn content is determined to be 2.0% or less. And, the Mn content is preferably contained in at least 0.05% or more.

(M3-d) Ni (Nickel)

Ni has an effect to enhance the stability of a mother phase in the heat-resisting steel according to the invention and enhances oxidation resistance at a high temperature. If the Ni content is less than 19% or exceeds 22%, the phase stability is lost, and desired strength characteristics cannot be exerted. Therefore, the Ni content is determined to be 19 to 22%.

(M3-e) Cr (Chromium)

Cr is indispensable as a component element of the $M_{23}C_6$ type carbide, and particularly, the creep strength of the heat-resisting steel is maintained by precipitating the $M_{23}C_6$ type carbide during the operation of the steam turbine in a high-temperature environment of 650° C. or more. And, Cr improves the resistance to oxidation in a high-temperature steam environment. If the Cr content is less than 24%, the resistance to oxidation and the precipitation amount of carbide become low, and if it exceeds 26%, precipitation of the $M_{23}C_6$ type carbide is promoted considerably, resulting in increasing the tendency of coarsening and accelerating precipitation of an embrittled phase. Therefore, the Cr content is determined to be 24 to 26%.

(M3-f) P (Phosphorus) and S (Sulfur)

Many types of unavoidable impurities are mingled and remained in heat-resisting steel. Among them, two elements of P and S are determined their upper limits. The upper limit of P is determined to be 0.045% capable of suppressing embrittlement caused by grain boundary segregation in a high-temperature environment, and the upper limit of S is determined to be 0.03% which does not affect on the characteristics because S is unavoidably mingled in the production of steel. These unavoidable impurities are preferably decreased as low as industrially possible to a residual content of 0%.

The radiation heat shielding pipe 140 is used to block radiation heat, so that the above-described austenite based material excelling in heat resistance can be used without necessity of welding connection or the like and without paying attention to workability and a coefficient of thermal expansion of material. Specifically, material corresponding to TYPE 310 specified in, for example, ASTM A167-77, A240-78 or AMS 5521D can be used.

As described above, the steam turbine of the first embodiment can introduce high-temperature steam of 650° C. or more into the extra-high-pressure turbine 100 and can improve thermal efficiency by having the inner casing 110, the nozzle box 115, the inner steam pipe 120 and the outer steam pipe 130 formed of the heat-resisting steel having the chemical composition ranges of (M1), the outer casing 111, which is cooled by the outer casing cooling means, formed of the cast steel having the chemical composition ranges of (M2), and the radiation heat shielding pipe 140, which is cooled by the cooling steam 160, formed of the heat-resisting steel having the chemical composition ranges of (M3).

And, the radiation heat shielding pipe 140 can be disposed to prevent the welded portion 150 from being heated directly by the radiation heat from the inner steam pipe 120. And, even if high-temperature steam of 650° C. or more is introduced, the surface temperatures of the outer casing 111 and the outer steam pipe 130 can be kept at 600° C. or less equivalent to that of a conventional plant by virtue of a cooling effect by the cooling steam 160 and a radiation heat shielding effect by the radiation heat shielding pipe 140. Thus, a thermal stress which is generated due to a difference in heat stretching between the outer casing 111 and the outer steam pipe 130 which is welded to the outer casing 111 can be decreased. And, reliability, operability and economical efficiency can be assured by having the outer casing 111 formed of ferrite-based alloy steel which is the same material as the material having lots of records of being used for conventional plants and the like and using the Ni-base heat-resisting steel for limited portions.

SECOND EMBODIMENT

The steam turbine power generation system 10 provided with the steam turbine of the second embodiment according to the invention has the same structure as that of the extra-high-pressure turbine 100 of the first embodiment except that the material form the inner casing 110, the nozzle box 115, the inner steam pipe 120 and the outer steam pipe 130 of the extra-high-pressure turbine 100 of the first embodiment is changed. Here, the material forming the inner casing 110, the nozzle box 115, the inner steam pipe 120 and the outer steam pipe 130 will be described. It should be noted that the ratio of chemical compositions shown below is expressed in "percent by weight".

(1) Inner Casing 110, Nozzle Box 115, Inner Steam Pipe 120 and Outer Steam Pipe 130

For the material forming the inner casing 110, the nozzle box 115, the inner steam pipe 120 and the outer steam pipe 130, heat-resisting steel (M4) having the following chemical composition ranges is used. (M4) Heat-resisting steel which contains C: 0.10 to 0.20, Si: 0.01 to 0.5, Mn: 0.01 to 0.5, Cr: 20 to 23, Co: 10 to 15, Mo: 8 to 10, Al: 0.01 to 1.5, Ti: 0.01 to 0.6, B: 0.001 to 0.006, and the balance of Ni and unavoidable impurities; and the unavoidable impurities are suppressed to Fe of 5 or less, P of 0.015 or less, S of 0.015 or less, and Cu of 0.5 or less.

Reasons of limiting the individual components of the heat-resisting steel (M4) to the above-described ranges will be described.

(M4-a) C (Carbon)

C is useful as a component element of the $M_{23}C_6$ type carbide which is a strengthening phase, and particularly, the creep strength of the heat-resisting steel is maintained by precipitating the $M_{23}C_6$ type carbide during the operation of the steam turbine in a high-temperature environment of 650° C. or more. If the C content is less than 0.10%, a desired creep strength cannot be assured because the precipitation amount of the $M_{23}C_6$ type carbide is not sufficient, and if it exceeds 0.20%, a tendency of component segregation when a large cast product is produced increases and the generation of the $M_6C$ type carbide which is an embrittlement phase is promoted. Therefore, the C content is determined to be 0.10 to 0.20%.

(M4-b) Si (Silicon)

Si has a deoxidizing effect and enhances cleanness of an ingot. But, if the Si content exceeds 0.5%, toughness of the heat-resisting steel is lowered, and embrittlement in a high-temperature environment of 650° C. or more is promoted. If the Si content is less than 0.01%, a desulfurizing effect is not attained, and the fluidity of a molten metal at the time of production of the ingot lowers. Therefore, the Si content determined to be 0.01 to 0.5%.

(M4-c) Mn (Manganese)

Mn has a desulfurizing effect and enhances cleanness of the ingot. But, if the Mn content exceeds 0.5%, Mn which remains as sulfides in the ingot increases considerably. If the Mn content is less than 0.01%, the desulfurizing effect is not attained. Therefore, the Mn content is determined to be 0.01 to 0.5%.

(M4-d) Cr (Chromium)

Cr is indispensable as a component element of the $M_{23}C_6$ type carbide, and particularly, the creep strength of the heat-resisting steel is maintained by precipitating the $M_{23}C_6$ type carbide during the operation of the steam turbine in a high-temperature environment of 650° C. or more. And, Cr improves the resistance to oxidation in a high-temperature steam environment. If the Cr content is less than 20%, the resistance to oxidation decreases, and if it exceeds 23%, precipitation of the $M_{23}C_6$ type carbide is promoted considerably, resulting in increasing the tendency of coarsening. Therefore, the Cr content is determined to be 20 to 23%.

(M4-e) Co (Cobalt)

Co has an effect of forming a solid solution in a Ni mother phase to improve the stability of the mother phase at a high temperature and suppresses the $M_{23}C_6$ type carbide from coarsening. If the Co content is less than 10%, desired characteristics cannot be exerted, and if it exceeds 15%, formability of a large ingot is decreased, and economical efficiency is degraded. Therefore, the Co content is determined to be 10 to 15%.

(M4-f) Mo (Molybdenum)

Mo has an effect of forming a solid solution in a Ni mother phase to enhance the strength of the mother phase, and its partial substitution in the $M_{23}C_6$ type carbide enhances the stability of the carbide. If the Mo content is less than 8%, the above effect is not exerted, and if it exceeds 10%, a tendency of component segregation at the time of producing a large ingot is increased, and the generation of $M_6C$ type carbide which is an embrittlement phase is promoted. Therefore, the Mo content is determined to be 8 to 10%.

(M4-g) Al (Aluminum)

Al is mainly added for deoxidization. Al might contribute to enhancement of precipitation by forming a γ' phase in Ni. But, a precipitation amount of the γ' phase in the heat-resisting steel according to the invention is not so large that effective precipitation strengthening can be expected, but because it is an active metal element, productivity in a melting step and in ingot production is degraded. Where a relatively large ingot is produced, the above characteristics become conspicuous if the Al content exceeds 1.5%. And, if the Al content is less than 0.01%, the deoxidizing effect cannot be obtained. Therefore, the Al content is determined to be 0.01 to 1.5%.

(M4-h) Ti (Titanium)

Ti is mainly added for deoxidization. Ti forms a γ' phase in Ni and might contribute to enhancement of precipitation. But, a precipitation amount of the γ' phase in the heat-resisting steel according to the invention is not so large that effective precipitation strengthening can be expected, but because it is an active metal element, productivity in a melting step and in ingot production is degraded. Where a relatively large ingot is produced, the above characteristics become conspicuous if the Ti content exceeds 0.6%. And, if the Ti content is less than 0.01%, the deoxidizing effect cannot be attained. Therefore, the Ti content is determined to be 0.01 to 0.6%.

(M4-i) B (Boron)

B is partly substituted in $M_{23}C_6$ type carbide which is a strengthening phase and provides effects of enhancing the stability of carbide at a high temperature and also enhancing ductility of the mother phase especially in the vicinity of grain boundary at a high temperature. These effects are exerted by addition of B in a very small amount of 0.001% or more, but if its addition exceeds 0.006%, a tendency of component segregation in a large ingot increases, deformation resistance when forging becomes high, and a forging crack is caused easily. Therefore, the B content is determined to be 0.001 to 0.006%.

(M4-j) Fe (Iron), P (Phosphorus), S (Sulfur) and Cu (Copper)

Many types of unavoidable impurities are mingled and remained in the heat-resisting steel. Among them, especially four elements Fe, P, S and Cu are determined their upper limits. For P and S, the upper limit is determined to be 0.015% capable of suppressing embrittlement caused by grain boundary segregation in a high-temperature environment, and the upper limits of Fe and Cu are determined to be 5% and 0.5% which do not affect on the characteristics because they are unavoidably mingled in the production of steel. These unavoidable impurities are preferably decreased as low as industrially possible to a residual content of 0%.

As described above, the steam turbine of the second embodiment can introduce high-temperature steam of 650° C. or more into the extra-high-pressure turbine 100 and can improve thermal efficiency by having the inner casing 110, the nozzle box 115, the inner steam pipe 120 and the outer steam pipe 130 formed of the heat-resisting steel having the chemical composition ranges of (M4), the outer casing 111, which is cooled by the outer casing cooling means, formed of the cast steel having the chemical composition range of (M2) described above, and the radiation heat shielding pipe 140, which is cooled by the cooling steam 160, formed of the heat-resisting steel having the chemical composition range of (M3) described above.

And, the radiation heat shielding pipe 140 can be disposed to prevent the welded portion 150 from being heated directly by the radiation heat from the inner steam pipe 120. And, even if high-temperature steam of 650° C. or more is introduced, the surface temperatures of the outer casing 111 and the outer steam pipe 130 can be kept at 600° C. or less equivalent to that of a conventional plant by virtue of a cooling effect by the cooling steam 160 and a radiation heat shielding effect by the radiation heat shielding pipe 140. Thus, a thermal stress which is generated due to a difference in heat stretching between the outer casing 111 and the outer steam pipe 130 which is welded to the outer casing 111 can be decreased. And, reliability, operability and economical efficiency can be assured by having the outer casing 111 formed of ferrite-based alloy steel which is the same material as the material having lots of records of being used for conventional plants and the like and using the Ni-base heat-resisting steel for limited portions.

The above embodiment was described assuming that the extra-high-pressure turbine 100 was the steam turbine according to the invention. But, the structure of the steam turbine according to the invention can be used for the structures of a high-pressure turbine and an intermediate-pressure turbine into which high-temperature steam of 650° C. or more is introduced.

THIRD EMBODIMENT

The steam turbine power generation system 10 provided with the steam turbine of the third embodiment according to the invention has the same structure as that of the extra-high-pressure turbine 100 of the first embodiment except that the material forming the inner casing 110, the nozzle box 115, the inner steam pipe 120 and the outer steam pipe 130 of the extra-high-pressure turbine 100 of the first embodiment is changed. Here, the material forming the inner casing 110, the nozzle box 115, the inner steam pipe 120 and the outer steam pipe 130 will be described. It should be noted that the ratio of chemical compositions shown below is expressed in "percent by weight".

(1) Inner Casing 110, Nozzle Box 115, Inner Steam Pipe 120 and Outer Steam Pipe 130

For the material forming the inner casing 110, the nozzle box 115, the inner steam pipe 120 and the outer steam pipe 130, heat-resisting steel (M5) having the following chemical composition ranges is used. (M5) Heat-resisting steel which contains C: 0.05 to 0.25, Si: 0.1 to 1.0, Mn: 0.1 to 1.0, Cr: 20 to 24, Mo: 8 to 10, Nb: 1 to 3, REM: 0.01 to 1.0, and the balance of Ni and unavoidable impurities; the unavoidable impurities are suppressed to Fe of 5 or less, Cu of 0.5 or less, P of 0.015 or less, S of 0.015 or less and Co of 1 or less; and its stress-relief heat treatment is performed at 700 to 1000° C.

The stress-relief heat treatment is performed by heating, for example, a thickness of 25.4 mm for one hour at 700 to 1000° C. The heating time per thickness is not limited to the above but can be determined appropriately.

Reasons of limiting the individual components of the heat-resisting steel (M5) to the above-described ranges will be described.

(M5-a) C (Carbon)

C is an element useful as a component element of carbide and also exerts an effect to secure the fluidity of a molten metal particularly for a Ni-base cast alloy. Precipitation of carbide by the stress-relief heat treatment before use of the heat-resisting steel according to the invention is suppressed as much as possible, and fine carbide is precipitated during the operation at about 700° C. for a long period of time to keep strength characteristics. But, if the C content exceeds 0.25%, a produced amount of coarse carbide or eutectic carbide in a state of non-solid solution which is formed when casting increases rapidly, and the precipitation amount of fine carbide precipitated when operating is decreased. And, if the C content is less than 0.05%, the fluidity of the molten metal is poor, and it becomes hard to produce a large complex-shaped cast product. Therefore, the C content is determined to be 0.05 to 0.25%.

(M5-b) Si (Silicon)

Si is useful as a deoxidizing agent and also exerts an effect to assure the fluidity of a molten metal. Si also improves the resistance to water vapor oxidation. But, if its contained amount is large, the degradation of toughness and embrittlement are promoted, so that it is desired to suppress its contained amount as small as possible in view of the above points. And, if the Si content exceeds 1.0%, the above-described characteristics are degraded considerably, and if it is less than 0.1%, the fluidity of the molten metal is poor, and it becomes difficult to produce a large complex-shaped cast product. Therefore, the Si content is determined to be 0.1 to 1.0%.

(M5-c) Mn (Manganese)

Mn is an element useful as a desulfurizing agent, and the Mn content is required to be at least 0.1%, and if it exceeds 1.0%, the produced amount of a non-metallic inclusion increases. Therefore, the Mn content is determined to be 0.1 to 1.0%.

(M5-d) Cr (Chromium)

Cr is effective for oxidation resistance and corrosion resistance and also useful as a component element of fine Cr carbide contributing to precipitation strengthening. But, if the Cr content is less than 20%, the corrosion resistance is insufficient in a high-temperature steam environment at about 700° C., and if it exceeds 24%, a produced amount of eutectic carbide when casting becomes considerable, and sufficient strength characteristics cannot be exerted. Therefore, the Cr content is determined to be 20 to 24%.

(M5-e) Mo (Molybdenum)

Mo contributes to solid solution hardening of a mother phase to enhance high-temperature strength and has an effect to decrease a thermal expansion amount at a high temperature, but if the Mo content is less than 8%, the above effects cannot be attained. Meanwhile, if the Mo content exceeds 10%, an embrittled phase is precipitated with time when heated at a high temperature, and the specific gravity of the alloy also increases to enhance the tendency of segregation. Therefore, the Mo content is determined to be 8 to 10%.

(M5-f) Nb (Niobium)

Nb forms a γ" phase having $Ni_3Nb$ as a basic structure when heated at a high temperature, and it has a precipitation strengthening action to become a factor to exert excellent high-temperature characteristics. Meanwhile, the γ" phase and its stable phase, namely a δ phase, become a cause to lower the toughness and ductility of the heat-resisting steel and promote embrittlement with time. If the Nb content is less than 1%, a sufficient precipitation amount of the γ" phase cannot be obtained, and desired strength cannot be exerted. And, if it exceeds 3%, the precipitation amount of the γ" phase becomes excessively large, and embrittlement with time becomes significant. Therefore, the Nb content is determined to be 1 to 3% to exert high-temperature strength at a temperature of about 700° C. and to suppress embrittlement with time. And, a more preferable Nb content is 1.5 to 2.5%. Necessity of addition of Nb to the heat-resisting steel according to the invention is judged for each part applying the heat-resisting steel.

(M5-g) Fe (Iron), P (Phosphorus), S (Sulfur) and Cu (Copper)

Generally, this heat-resisting steel which is produced by using a melting furnace for melting an iron-steel material cannot avoid mixing of Fe from the furnace wall, and the upper limit of the Fe content not affecting on the mechanical properties is determined to be 5%. And, Cu, P and S are mostly mixed from the raw materials. Therefore, it is suppressed to have the Cu content of 0.5% or less, the P content of 0.015% or less, and the S content of 0.015% or less. And, these unavoidable impurities are preferably decreased as low as industrially possible to a residual content of 0%.

(M5-h) REM (Rare-Earth Metal)

The heat-resisting steel according to the invention is produced by melting in the atmosphere and casting in the atmosphere, so that the effect of the active element such as Al or Ti as a deoxidizing agent might not be expected. And, the added amount of Mn is limited from viewpoints of suppressing the produced amount of a non-metallic inclusion, so that a desulfurizing effect might not be exerted to a maximum extent. And, if deoxidation or desulfurization is insufficient and oxide or sulfide having a high specific gravity is produced, its separation from the molten metal is difficult, and such a product remains in ingot to degrade the cleanness of heat-resisting steel. When a slight amount of REM is added, the heat-resisting steel according to the invention exerts effects for deoxidation and desulfurization to enhance cleanness and also has an effect to improve weldability of heat-resisting steel because the S content is reduced. The REM suitable for the heat-resisting steel according to the invention is preferably formed to contain at least four types of rare earth elements such as Ce (cerium), La (lanthanum), Nd (neodynium) and Pr (praseodymium). When a total content of the above REMs is less than 0.01%, both the deoxidizing effect and the desulfurizing effect are not attained. Meanwhile, when it exceeds 1.0%, their remaining amounts in the ingot become large to degrade the mechanical properties. Therefore, the total content of REMs is determined to be 0.01 to 1.0%.

As described above, the steam turbine of the third embodiment can introduce high-temperature steam of 650° C. or more into the extra-high-pressure turbine 100 and can improve thermal efficiency by having the inner casing 110, the nozzle box 115, the inner steam pipe 120 and the outer steam pipe 130 formed of the heat-resisting steel having the chemical composition ranges of (M5), the outer casing 111, which is cooled by the outer casing cooling means, formed of the cast steel having the chemical composition ranges of (M2) described above, and the radiation heat shielding pipe 140, which is cooled by the cooling steam 160, formed of the heat-resisting steel having the chemical composition ranges of (M3) described above. And, the heat-resisting steel having the chemical composition ranges of (M5) is merely subjected to a heat treatment for a stress-relief annealing at 700 to 1000° C. and not required to be subjected to a solution treatment or an aging heat treatment. Thus, sufficient mechanical properties are secured, the production process can be simplified, and the production cost and the like can be reduced.

The radiation heat shielding pipe 140 can be disposed to prevent the welded portion 150 from being heated directly by the radiation heat from the inner steam pipe 120. Even if high-temperature steam of 650° C. or more is introduced, the surface temperatures of the outer casing 111 and the outer steam pipe 130 can be kept at 600° C. or less equivalent to that of a conventional plant by virtue of a cooling effect by the cooling steam 160 and a radiation heat shielding effect by the radiation heat shielding pipe 140. Thus, a thermal stress which is generated from a difference in heat stretching between the outer casing 111 and the outer steam pipe 130 which is welded to the outer casing 111 can be decreased. And, the outer casing 111 is formed of ferrite-based alloy steel which is the same material as the material having lots of records of being used for conventional plants and the like, and reliability, operability and economical efficiency can be assured by using the Ni-base heat-resisting steel for limited portions.

FOURTH EMBODIMENT

The steam turbine power generation system 10 provided with the steam turbine of the fourth embodiment according to the invention has the same structure as that of the extra-high-pressure turbine 100 of the first embodiment except that the material forming the inner casing 110, the nozzle box 115, the inner steam pipe 120 and the outer steam pipe 130 of the extra-high-pressure turbine 100 of the first embodiment is changed. Here, the material forming the inner casing 110, the nozzle box 115, the inner steam pipe 120 and the outer steam pipe 130 will be described. It should be noted that the ratio of chemical compositions shown below is expressed in "percent by weight".

(1) Inner Casing 110, Nozzle Box 115, Inner Steam Pipe 120 and Outer Steam Pipe 130

For the material forming the inner casing 110, the nozzle box 115, the inner steam pipe 120 and the outer steam pipe 130, the heat-resisting steel (M6) having the following chemical composition ranges is used. (M6) Heat-resisting steel which contains C: 0.05 to 0.25, Si: 0.1 to 1.0, Mn: 0.1 to 1.0, Cr: 20 to 24, Co: 10 to 15, Mo: 8 to 10, B: 0.001 to 0.006, REM: 0.01 to 1.0, and the balance of Ni and unavoidable impurities; the unavoidable impurities are suppressed to Fe of 5 or less, Cu of 0.5 or less, P of 0.015 or less, S of 0.015 or less, Al of 0.05 or less and Ti of 0.05 or less; and its stress-relief heat treatment is performed at 700 to 1000° C.

The stress-relief heat treatment was performed by heating, for example, a thickness of 25.4 mm for one hour at 700 to 1000° C. The heating time per thickness is not limited to the above but can be determined appropriately.

Reasons of limiting the individual components of the heat-resisting steel (M6) to the above-described ranges will be described.

(M6-a) C (Carbon)

C is an element useful as a component element of carbide and also exerts an effect to secure the fluidity of a molten metal particularly for a Ni-base cast alloy. Precipitation of carbide by the stress-relief heat treatment before use of the heat-resisting steel according to the invention is suppressed as much as possible, and fine carbide is precipitated during the operation at about 700° C. for a long period of time to keep strength characteristics. But, if the C content exceeds 0.25%, a produced amount of coarse carbide or eutectic carbide in a state of non-solid solution which is formed when casting increases rapidly, and the precipitation amount of fine carbide precipitated when operating is decreased. And, if the C content is less than 0.05%, the fluidity of the molten metal is poor, and it becomes hard to produce a large complex-shaped cast product. Therefore, the C content is determined to be 0.05 to 0.25%.

(M6-b) Si (Silicon)

Si is useful as a deoxidizing agent and also exerts an effect to assure the fluidity of a molten metal. Si also improves the resistance to water vapor oxidation. But, if the Si content is large, the degradation of toughness and embrittlement are promoted, so that it is desired to suppress the Si content as small as possible in view of the above points. And, if the Si content exceeds 1.0%, the above-described characteristics are degraded considerably, and if it is less than 0.1%, the fluidity of a molten metal is poor, and it becomes difficult to produce a large complex-shaped cast product. Therefore, the Si content is determined to be 0.1 to 1.0%.

(M6-c) Mn (Manganese)

Mn is an element useful as a desulfurizing agent, and the Mn content is required to be at least 0.1%, and if it exceeds 1.0%, the produced amount of a non-metallic inclusion increases. Therefore, the Mn content is determined to be 0.1 to 1.0%.

(M6-d) Cr (Chromium)

Cr is effective for oxidation resistance and corrosion resistance and also useful as a component element of fine Cr carbide contributing to precipitation strengthening. But, if the Cr content is less than 20%, the corrosion resistance is insufficient in a high-temperature steam environment at about 700° C., and if it exceeds 24%, a produced amount of eutectic carbide when casting becomes considerable, and sufficient strength characteristics cannot be exerted. Therefore, the Cr content is determined to be 20 to 24%.

(M6-e) Mo (Molybdenum)

Mo contributes to solid solution hardening of a mother phase to enhance high-temperature strength and has an effect to decrease a thermal expansion amount at a high temperature, but if the Mo content is less than 8%, the above effects cannot be attained. Meanwhile, if the Mo content exceeds 10%, an embrittled phase is precipitated with time when heated at a high temperature, and the specific gravity of the alloy also increases to enhance the tendency of segregation. Therefore, the Mo content is determined to be 8 to 10%.

(M6-f) Co (Cobalt)

Co contributes to solid solution hardening of a mother phase and enhances the high-temperature strength and the stability of precipitates after heating at a high temperature for a long period of time. Such effects are exerted when the Co content is 10% or more. Meanwhile, if the Co content exceeds 15%, workability and economical efficiency are impaired considerably. Therefore, the Co content is determined to be 10 to 15%. Necessity of addition of Co to the heat-resisting steel according to the invention is judged for each part applying the heat-resisting steel.

(M6-g) B (Boron)

B enhances high-temperature stability of precipitates and contributes to strengthening of a grain boundary. Such effects are attained when the B content is 0.001% or more, but if the B content exceeds 0.006%, segregation is promoted, and it is bonded to N (nitrogen) in the atmosphere to produce a coarse compound. Therefore, the B content is determined to be 0.001 to 0.006%. Necessity of addition of B to the heat-resisting steel according to the invention is judged for each part applying the heat-resisting steel.

(M6-h) Al (Aluminum) and Ti (Titanium)

Al and Ti are generally indispensable elements as component elements of a γ' phase which is a main reinforcing phase of the Ni-base heat-resisting cast alloy. But, in the production of large cast parts for which melting in the atmosphere and casting in the atmosphere are inevitable, it is hard to control the contained amount when melting and to obtain homogeneous concentration distribution when casting. And, the fluidity of a molten metal is degraded and mechanical properties are degraded due to the production of a large amount of a non-metallic inclusion. Therefore, Al and Ti are not added intentionally to the heat-resisting steel of the invention. Each residual content of final Al and Ti as unavoidable impurities is restricted to 0.05% or less, and it is desirable that the residual content is decreased as low as possible toward 0%.

(M6-i) Fe (Iron), P (Phosphorus), S (Sulfur) and Cu (Copper)

Generally, this heat-resisting steel which is produced by using a melting furnace for melting an iron-steel material cannot avoid mixing of Fe from the furnace wall, and the upper limit of the Fe content not affecting on the mechanical properties is determined to be 5%. And, Cu, P and S are mostly mixed from the raw materials. Therefore, it is suppressed to have the Cu content of 0.5% or less, the P content of 0.015% or less and the S content of 0.015% or less. And, these unavoidable impurities are preferably decreased as low as industrially possible to a residual content of 0%.

(M6-j) REM (Rare-Earth Metal)

The heat-resisting steel according to the invention is produced by melting in the atmosphere and casting in the atmosphere, so that the effect of the active element such as Al or Ti as a deoxidizing agent might not be expected. And, the added amount of Mn is limited from viewpoints of suppressing the produced amount of a non-metallic inclusion, so that a desulfurizing effect might not be exerted to a maximum extent. And, if deoxidation or desulfurization is insufficient and oxide or sulfide having a high specific gravity is produced, its separation from the molten metal is difficult, and such a product remains in ingot to degrade the cleanness of heat-resisting steel. When a slight amount of REM is added, the heat-resisting steel according to the invention exerts effects for deoxidation and desulfurization to enhance cleanness and also has an effect to improve weldability of heat-resisting steel because the S content is reduced. The REM suitable for the heat-resisting steel according to the invention is preferably formed to contain at least four types of rare earth elements such as Ce (cerium), La (lanthanum), Nd (neodynium) and Pr (praseodymium). When a total content of the above REMs is less than 0.01%, both the deoxidizing effect and the desulfurizing effect are not attained. Meanwhile, when it exceeds 1.0%, their remaining amounts in the ingot become large to degrade the mechanical properties. Therefore, the total content of REMs is determined to be 0.01 to 1.0%.

As described above, the steam turbine of the fourth embodiment can introduce high-temperature steam of 650° C. or more into the extra-high-pressure turbine 100 and can improve thermal efficiency by having the inner casing 110, the nozzle box 115, the inner steam pipe 120 and the outer steam pipe 130 formed of the heat-resisting steel having the chemical composition ranges of (M6), the outer casing 111, which is cooled by the outer casing cooling means, formed of the cast steel having the chemical composition ranges of (M2) described above, and the radiation heat shielding pipe 140, which is cooled by the cooling steam 160, formed of the heat-resisting steel having the chemical composition ranges of (M3) described above. And, the heat-resisting steel having the chemical composition ranges of (M6) is merely subjected to a heat treatment for a stress-relief annealing at 700 to 1000° C. and not required to be subjected to a solution treatment or an aging heat treatment. Thus, sufficient mechanical properties are secured, the production process can be simplified, and the production cost and the like can be reduced.

The radiation heat shielding pipe 140 can be disposed to prevent the welded portion 150 from being heated directly by the radiation heat from the inner steam pipe 120. Even if high-temperature steam of 650° C. or more is introduced, the surface temperatures of the outer casing 111 and the outer steam pipe 130 can be kept at 600° C. or less equivalent to that of a conventional plant by virtue of a cooling effect by the cooling steam 160 and a radiation heat shielding effect by the radiation heat shielding pipe 140. Thus, a thermal stress which is generated from a difference in heat stretching between the outer casing 111 and the outer steam pipe 130 which is welded to the outer casing 111 can be decreased. And, the outer casing 111 is formed of ferrite-based alloy steel which is the same material as the material having lots of records of being used for conventional plants and the like, and reliability, operability and economical efficiency can be assured by using the Ni-base heat-resisting steel for limited portions.

FIFTH EMBODIMENT

A steam turbine power generation system 10 provided with the steam turbine of the fifth embodiment according to the invention has the same structure as that of the extra-high-pressure turbine 100 of the first to fourth embodiments except that the material forming the outer casing 111 of the extra-high-pressure turbine 100 of the first to fourth embodiments is changed. Here, the material forming the outer casing 111 will be described. It should be noted that the ratio of chemical compositions shown below is expressed in "percent by weight".

(1) Outer Casing 111

(M7) Heat-resisting cast steel which contains C: 0.12 to 0.18, Si: 0.2 to 0.6, Mn: 0.5 to 0.9, Cr: 1.0 to 1.5, V: 0.2 to 0.35, Mo: 0.9 to 1.2, Ti: 0.01 to 0.04, and the balance of Fe and unavoidable impurities, and the unavoidable impurities are suppressed to P of 0.02 or less, S of 0.012 or less, Al of 0.01 or less, Ni of 0.5 or less and Cu of 0.35 or less.

Reasons of limiting the individual components of the heat-resisting cast steel (M7) to the above-described ranges will be described.

(M7-a) C (Carbon)

C is an element useful as a component element of carbide. The heat-resisting cast steel according to the invention can secure a sufficient precipitation amount of carbide when the C content is 0.12% or more. Meanwhile, if the C content exceeds 0.18%, weldability is inhibited, and aggregation and coarsening of carbide involved in heating at a high temperature for a long period of time are promoted. Therefore, the C content is determined to be 0.12 to 0.18%.

(M7-b) Si (Silicon)

Si is useful as a deoxidizing agent and also exerts an effect to assure the fluidity of a molten metal. Si also improves the resistance to water vapor oxidation. But, if the Si content is large, the degradation of toughness and embrittlement are promoted, so that it is desired to suppress the Si content as small as possible in view of the above points. And, if the Si content exceeds 0.6%, the above-described characteristics are degraded considerably, and if it is less than 0.2%, the fluidity of a molten metal is poor, and it becomes difficult to produce a large complex-shaped cast product. Therefore, the Si content is determined to be 0.2 to 0.6%.

(M7-c) Mn (Manganese)

Mn is an element useful as a desulfurizing agent, and the Mn content is required to be at least 0.5%, and if it exceeds 0.9%, the produced amount of a non-metallic inclusion increases. Therefore, the Mn content is determined to be 0.5 to 0.9%.

(M7-d) Cr (Chromium)

Cr is effective for oxidation resistance and corrosion resistance and also useful as a component element of fine Cr carbide contributing to precipitation strengthening. But, if the Cr content is less than 1.0%, such effects are not exerted and, if it exceeds 1.5%, aggregation and coarsening of carbide involved in heating at a high temperature for a long period of time are promoted. Therefore, the Cr content is determined to be 1.0 to 1.5%.

(M7-e) V (Vanadium)

V contributes to precipitation strengthening by forming fine carbonitride. The heat-resisting cast steel according to the invention exerts such effects when the V content is 0.2% or more. Meanwhile, if the V content exceeds 0.35%, toughness is degraded, and embrittlement due to heating at a high temperature is promoted. Therefore, the V content is determined to be 0.2 to 0.35%.

(M7-f) Mo (Molybdenum)

Mo contributes to solid solution hardening of a mother phase to enhance high-temperature strength and has an effect to improve the stability of carbide. But, if the Mo content is less than 0.9% in the heat-resisting cast steel according to the invention, such effects cannot be attained. Meanwhile, if the Mo content exceeds 1.2%, toughness is degraded and precipitation of an embrittled phase due to heating at a high temperature is promoted. Therefore, the Mo content is determined to be 0.9 to 1.2%.

(M7-g) Ti (Titanium)

Ti is useful as a deoxidizing agent in the production of large cast parts for which casting in the atmosphere is inevitable. But, if the Ti content is less than 0.01%, such an effect cannot be attained, and if it exceeds 0.04%, the produced amounts of coarse Ti carbonitride and inclusions increase. Therefore, the Ti content is determined to be 0.01 to 0.04%.

(M7-h) P (Phosphorus), S (Sulfur), Al (Aluminum), Ni (Nickel) and Cu (Copper)

Many types of unavoidable impurities are mingled and remained in heat-resisting steel. For five elements of P, S, Al, Ni and Cu among them, it is confirmed that such unavoidable impurities do not affect on the characteristics of the heat-resisting cast steel if their contained amounts are very small. Therefore, the upper limits of such unavoidable impurities are determined in a range that the characteristics of the heat-resisting cast steel are not affected so to have the P content of 0.02% or less, the S content of 0.012% or less, the Al content of 0.01% or less, the Ni content of 0.5% or less, and the Cu content of 0.35% or less. And, these unavoidable impurities are preferably decreased as low as industrially possible to a residual content of 0%.

As described above, the steam turbine of the fifth embodiment can introduce high-temperature steam of 650° C. or more into the extra-high-pressure turbine 100 and can improve thermal efficiency by having the inner casing 110, the nozzle box 115, the inner steam pipe 120 and the outer steam pipe 130 formed of the heat-resisting steel having the chemical composition ranges of any of the above-described (M1), (M4) to (M6), the outer casing 111, which is cooled by the outer casing cooling means, formed of the heat-resisting steel having the chemical composition ranges of (M7), and the radiation heat shielding pipe 140, which is cooled by the cooling steam 160, formed of the heat-resisting steel having the chemical composition ranges of the above-described (M3).

The radiation heat shielding pipe 140 can be disposed to prevent the welded portion 150 from being heated directly by the radiation heat from the inner steam pipe 120. Even if high-temperature steam of 650° C. or more is introduced, the surface temperatures of the outer casing 111 and the outer steam pipe 130 can be kept at 600° C. or less equivalent to that of a conventional plant by virtue of a cooling effect by the cooling steam 160 and a radiation heat shielding effect by the radiation heat shielding pipe 140. Thus, a thermal stress which is generated due to a difference in heat stretching between the outer casing 111 and the outer steam pipe 130 which is welded to the outer casing 111 can be decreased. And, reliability, operability and economical efficiency can be assured by having the outer casing 111 formed of ferrite-based alloy steel which is the same material as the material having lots of records of being used for conventional plants and the like and using the Ni-base heat-resisting steel for limited portions.

The above individual embodiments were described assuming that the extra-high-pressure turbine 100 was the steam turbine according to the invention. But, the structure of the steam turbine according to the invention can be used for the structures of a high-pressure turbine and an intermediate-pressure turbine into which the high-temperature steam of 650° C. or more is introduced.

What is claimed is:

1. A steam turbine, comprising:

an inner steam pipe which is disposed through an inner casing and an outer casing and connected to a nozzle box;

an outer steam pipe which is welded to the outer casing and disposed outside of the inner steam pipe along the inner steam pipe with a prescribed space between them; and a radiation heat shielding pipe which is disposed between the inner steam pipe and the outer steam pipe along the inner steam pipe to face a welded portion of at least the outer steam pipe, wherein cooling steam is flown between the inner steam pipe and the outer steam pipe, and high-temperature steam of 650° C. or more is introduced into the steam turbine;

wherein the outer casing is formed of a cast steel which contains in percent by weight C: 0.05 to 0.15, Si: 0.3 or less, Mn: 0.1 to 1.5, Ni: 1.0 or less, Cr: 9 or more and less than 10, V: 0.1 to 0.3, Mo: 0.6 to 1.0, W: 1.5 to 2.0, Co: 1.0 to 4.0, Nb: 0.02 to 0.08, B: 0.001 to 0.008, N: 0.005 to 0.1, Ti: 0.001 to 0.03, and the balance of Fe and unavoidable impurities;

wherein the inner casing, the inner steam pipe and the outer steam pipe are formed of at least one heat-resisting steel selected from (1) heat-resisting steel which contains in percent by weight C: 0.03 to 0.25, Si: 0.01 to 1.0, Mn: 0.01 to 1.0, Cr: 20 to 23, Mo: 8 to 10, Nb: 1.15 to 3.0, and the balance of Ni and unavoidable impurities, and the unavoidable impurities including Fe: 5 or less, P: 0.015 or less, S: 0.015 or less and Cu: 0.5 or less;

(2) heat-resisting steel which contains in percent by weight C: 0.10 to 0.20, Si: 0.01 to 0.5, Mn: 0.01 to 0.5, Cr: 20 to 23, Co: 10 to 15, Mo: 8 to 10, Al: 0.01 to 1.5, Ti: 0.01 to 0.6, B: 0.001 to 0.006, and the balance of Ni and unavoidable impurities, and the unavoidable impurities including Fe: 5 or less, P: 0.015 or less, S: 0.015 or less and Cu: 0.5 or less;

(3) heat-resisting steel which contains in percent by weight C: 0.05 to 0.25, Si: 0.1 to 1.0, Mn: 0.1 to 1.0, Cr: 20 to 24, Mo: 8 to 10, Nb: 1 to 3, REM: 0.01 to 1.0, and the balance of Ni and unavoidable impurities, the unavoidable impurities including Fe: 5 or less, Cu: 0.5 or less, P: 0.015 or less, S: 0.015 or less and Co: 1 or less, with a stress-relief heat treatment performed at 700 to 1000° C.; and (4) heat-resisting steel which contains in percent by weight C: 0.05 to 0.25, Si: 0.1 to 1.0, Mn: 0.1 to 1.0, Cr: 20 to 24, Co: 10 to 15, Mo: 8 to 10, B: 0.001 to 0.006, REM: 0.01 to 1.0, and the balance of Ni and unavoidable impurities, the unavoidable impurities including Fe: 5 or less, Cu: 0.5 or less, P: 0.015 or less, S: 0.015 or less, Al: 0.05 or less and Ti: 0.05 or less, with a stress-relief heat treatment performed at 700 to 1000° C.; and wherein the radiation heat shielding pipe is formed of heat-resisting steel which contains in percent by weight C: 0.25 or less, Si: 1.5 or less, Mn: 2.0 or less, Ni: 19 to 22, Cr: 24 to 26, and the balance of Fe and unavoidable impurities, and the unavoidable impurities including P: 0.045 or less and S: 0.03 or less.

2. The steam turbine according to claim 1, wherein the cooling steam is exhaust steam of the steam turbine.

3. The steam turbine according to claim 1, wherein the cooling steam is steam extracted from a halfway stage of the steam turbine.

4. A steam turbine, comprising:

an inner steam pipe which is disposed through an inner casing and an outer casing and connected to a nozzle box;

an outer steam pipe which is welded to the outer casing and disposed outside of the inner steam pipe along the inner steam pipe with a prescribed space between them; and a radiation heat shielding pipe which is disposed between the inner steam pipe and the outer steam pipe along the inner steam pipe to face a welded portion of at least the outer steam pipe, wherein cooling steam is flown between the inner steam pipe and the outer steam pipe, and high-temperature steam of 650° C. or more is introduced into the steam turbine;

wherein the outer casing is formed of a heat-resisting cast steel which contains in percent by weight C: 0.12 to 0.18, Si: 0.2 to 0.6, Mn: 0.5 to 0.9, Cr: 1.0 to 1.5, V: 0.2 to 0.35, Mo: 0.9 to 1.2, Ti: 0.01 to 0.04, and the balance of Fe and unavoidable impurities, and the unavoidable impurities including P: 0.02 or less, S: 0.012 or less, Al: 0.01 or less, Ni: 0.5 or less and Cu: 0.35 or less;

wherein the inner casing, the inner steam pipe and the outer steam pipe are formed of at least one heat-resisting steel selected from (1) heat-resisting steel which contains in percent by weight C: 0.03 to 0.25, Si: 0.01 to 1.0, Mn: 0.01 to 1.0, Cr: 20 to 23, Mo: 8 to 10, Nb: 1.15 to 3.0, and the balance of Ni and unavoidable impurities, and the unavoidable impurities including Fe: 5 or less, P: 0.015 or less, S: 0.015 or less, Cu: 0.5 or less;

(2) heat-resisting steel which contains in percent by weight C: 0.10 to 0.20, Si: 0.01 to 0.5, Mn: 0.01 to 0.5, Cr: 20 to 23, Co: 10 to 15, Mo: 8 to 10, Al: 0.01 to 1.5, Ti: 0.01 to 0.6, B: 0.001 to 0.006, and the balance of Ni and unavoidable impurities, and the unavoidable impurities including Fe: 5 or less, P: 0.015 or less, S: 0.015 or less and Cu: 0.5 or less;

(3) heat-resisting steel which contains in percent by weight C: 0.05 to 0.25, Si: 0.1 to 1.0, Mn: 0.1 to 1.0, Cr: 20 to 24, Mo: 8 to 10, Nb: 1 to 3, REM: 0.01 to 1.0, and the balance of Ni and unavoidable impurities, and the unavoidable impurities including Fe: 5 or less, Cu: 0.5 or less, P: 0.015 or less, S: 0.015 or less and Co: 1 or less, with a stress-relief heat treatment performed at 700 to 1000° C.; and (4) heat-resisting steel which contains in percent by weight C: 0.05 to 0.25, Si: 0.1 to 1.0, Mn: 0.1 to 1.0, Cr: 20 to 24, Co: 10 to 15, Mo: 8 to 10, B: 0.001 to 0.006, REM: 0.01 to 1.0, and the balance of Ni and unavoidable impurities, and the unavoidable impurities including Fe: 5 or less, Cu: 0.5 or less, P: 0.015 or less, S: 0.015 or less, Al: 0.05 or less and Ti: 0.05 or less, with a stress-relief heat treatment performed at 700 to 1000° C.; and wherein the radiation heat shielding pipe is formed of heat-resisting steel which contains in percent by weight C: 0.25 or less, Si: 1.5 or less, Mn: 2.0 or less, Ni: 19 to 22, Cr: 24 to 26, and the balance of Fe and unavoidable impurities, and the unavoidable impurities including P: 0.045 or less and S: 0.03 or less.

5. The steam turbine according to claim 4, wherein the cooling steam is exhaust steam of the steam turbine.

6. The steam turbine according to claim 4, wherein the cooling steam is steam extracted from a halfway stage of the steam turbine.

* * * * *